US008584283B2

(12) United States Patent
Mabry

(10) Patent No.: US 8,584,283 B2
(45) Date of Patent: Nov. 19, 2013

(54) PORTABLE SLEEPING DEVICE

(76) Inventor: Robert Mabry, Nashville, TN (US)

( * ) Notice: Subject to any disclaimer, the term of this patent is extended or adjusted under 35 U.S.C. 154(b) by 290 days.

(21) Appl. No.: 13/090,239

(22) Filed: Apr. 19, 2011

(65) Prior Publication Data

US 2011/0277238 A1 Nov. 17, 2011

Related U.S. Application Data

(60) Provisional application No. 61/345,246, filed on May 17, 2010.

(51) Int. Cl.
*A47C 20/00* (2006.01)

(52) U.S. Cl.
USPC ..... 5/632; 5/657; 190/2; 248/118

(58) Field of Classification Search
USPC ..... 5/621–623, 632, 636, 640, 643, 646, 5/657; 128/845; 248/118; 297/391, 393; 190/1, 2, 8; 108/11, 149, 166; 224/156, 224/577, 679
See application file for complete search history.

(56) References Cited

U.S. PATENT DOCUMENTS

| | | | | |
|---|---|---|---|---|
| 2,738,249 | A * | 3/1956 | Tenenblatt | 312/237 |
| 5,176,422 | A | 1/1993 | Canet | |
| 5,611,601 | A * | 3/1997 | Cowgur | 297/393 |
| 6,857,149 | B2 * | 2/2005 | Hoggatt et al. | 5/632 |
| 7,350,250 | B2 * | 4/2008 | Froelich | 5/637 |
| 7,422,016 | B2 * | 9/2008 | Klemm | 128/845 |
| 7,478,445 | B2 * | 1/2009 | De Vries | 5/601 |

FOREIGN PATENT DOCUMENTS

| | | |
|---|---|---|
| JP | 3054113 | 9/1998 |
| KR | 20-1983-0003044 | 12/1983 |
| KR | 20-2008-0001910 | 6/2008 |

* cited by examiner

*Primary Examiner* — Nicholas Polito
(74) *Attorney, Agent, or Firm* — Superior IP, PLLC; Dustin L. Call

(57) ABSTRACT

One example embodiment includes a portable sleeping device. The portable sleeping device includes a headrest, where the headrest is configured to support the head of a user. The portable sleeping device also includes a trunk support, where the trunk support is configured to support the trunk of the user while sleeping in a sitting position.

9 Claims, 6 Drawing Sheets

PORTABLE SLEEPING DEVICE

CROSS-REFERENCE TO RELATED APPLICATIONS

This application claims the benefit of and priority to U.S. Provisional Patent Application Ser. No. 61/345,246 filed on May 17, 2010, which application is incorporated herein by reference in its entirety.

BACKGROUND OF THE INVENTION

Sleeping comfortably while traveling or while confined to tight spaces is generally desirable, yet unfortunately this is often made difficult or impossible by the circumstances. Recuperative resting, napping and/or deep rapid eye movement (REM) sleep is often inhibited by discomfort caused by awkward body positions that depend on some level of muscle activity to maintain. For example, sitting in an airplane seat without leaning on or otherwise disturbing adjacent passengers, even while fully reclined, can necessitate flexing of neck, shoulder, back and/or other muscles to maintain that position.

Holding or supporting the head in an upright position while attempting to sleep and/or utilizing devices that aid in doing so prevents the cervicobrachial apparatus from being totally passive or at complete rest. In addition, static load stress in the cervical spine can be debilitating for people with degenerative conditions and/or post-surgical syndromes. Furthermore, there is data in the medical community suggesting that baroreceptors in the walls of the heart are sensitive to pressure such that holding the head in an upright position results in increased brain activity which can inhibit sleep quality. In addition, there is also data suggesting that calcium oxalates in the inner ear may regulate REM cycles by effecting equilibrium when the head is in a horizontal position. Such phenomenon would not occur in sleeping positions where the head is held upright.

Accordingly, there is a need in the art for a device which supports a user while sleeping in a sitting position. Additionally, there is a need in the art for the device to support the head and neck of the user. Further, there is a need in the art for the device to support the trunk of the user. Moreover, there is a need in the art for the device to be easily transported.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a portable sleeping device. The portable sleeping device includes a headrest, where the headrest is configured to support the head of a user. The portable sleeping device also includes a trunk support, where the trunk support is configured to support the trunk of the user while sleeping in a sitting position.

Another example embodiment includes a portable sleeping device. The portable sleeping device includes a headrest, where the headrest is configured to support the head of a user, and a trunk support, where the trunk support is configured to support the trunk of the user. The portable sleeping device also includes a pivot shaft, where the pivot shaft is configured to connect the headrest to the trunk support and allow the headrest to rotate relative to the trunk support. The portable sleeping device further includes a support shaft, where the support shaft is configured to support the trunk support in the position desired by the user.

Another example embodiment includes a portable sleeping device. The portable sleeping device includes a case. The case includes a first portion and a second portion, where the second portion is attached to the first portion. The portable sleeping device also includes a headrest, where the headrest is configured to support the head of a user. The portable sleeping device further includes a pivot shaft, where the pivot shaft is configured to connect the headrest to the second portion of the case and allow the headrest to rotate relative to the second portion of the case. The portable sleeping device also includes a ratcheting mechanism, where the ratcheting mechanism is configured to prevent rotation of the headrest in at least one direction relative to the second portion of the case. The portable sleeping device further includes a support shaft, where the support shaft is configured to support the position of the second portion of the case relative to the first portion of the case. The support shaft includes a first section and a second section, where the second section is configured to move relative to the first section in order to allow the user to change the length of the support shaft. The portable sleeping device also includes one or more position stops, where the position stops are configured to prevent movement of the support shaft relative to the first portion of the case. The portable sleeping device further includes one or more hand rests, wherein the one or more hand rests are configured to support the hands of the user.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
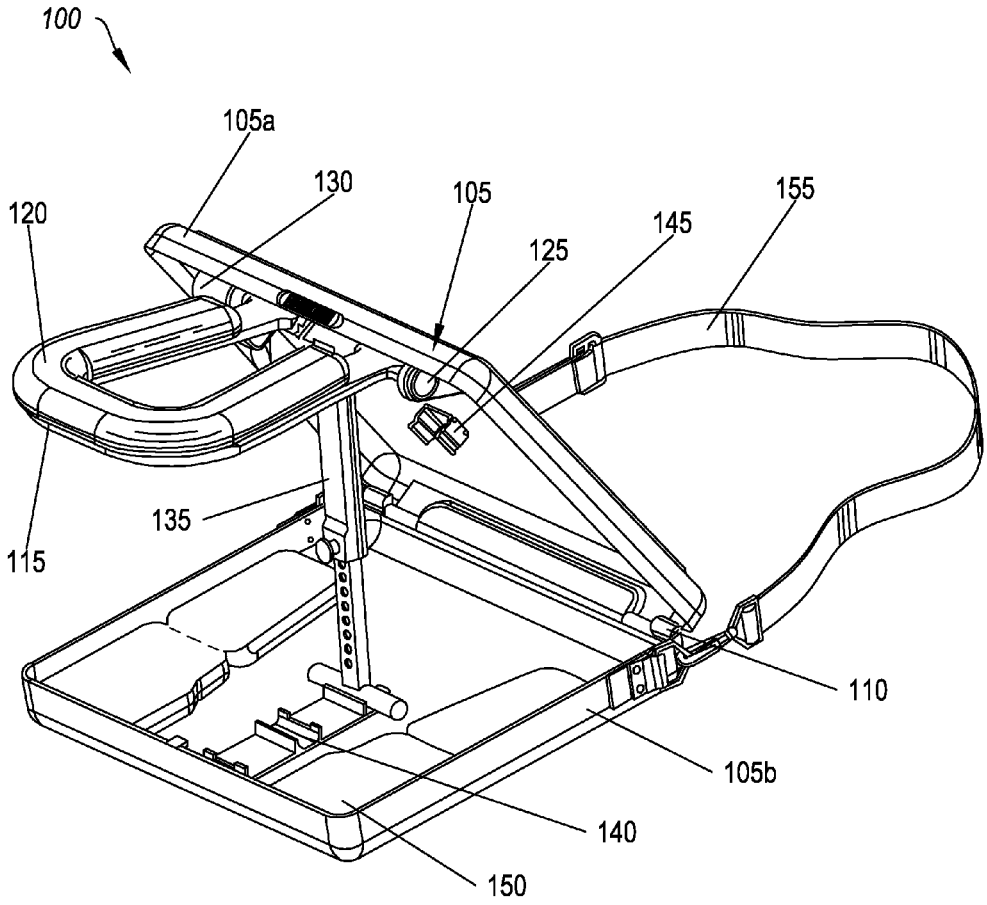
FIG. 1A is a perspective view of the portable sleeping device.
Figure 1B:
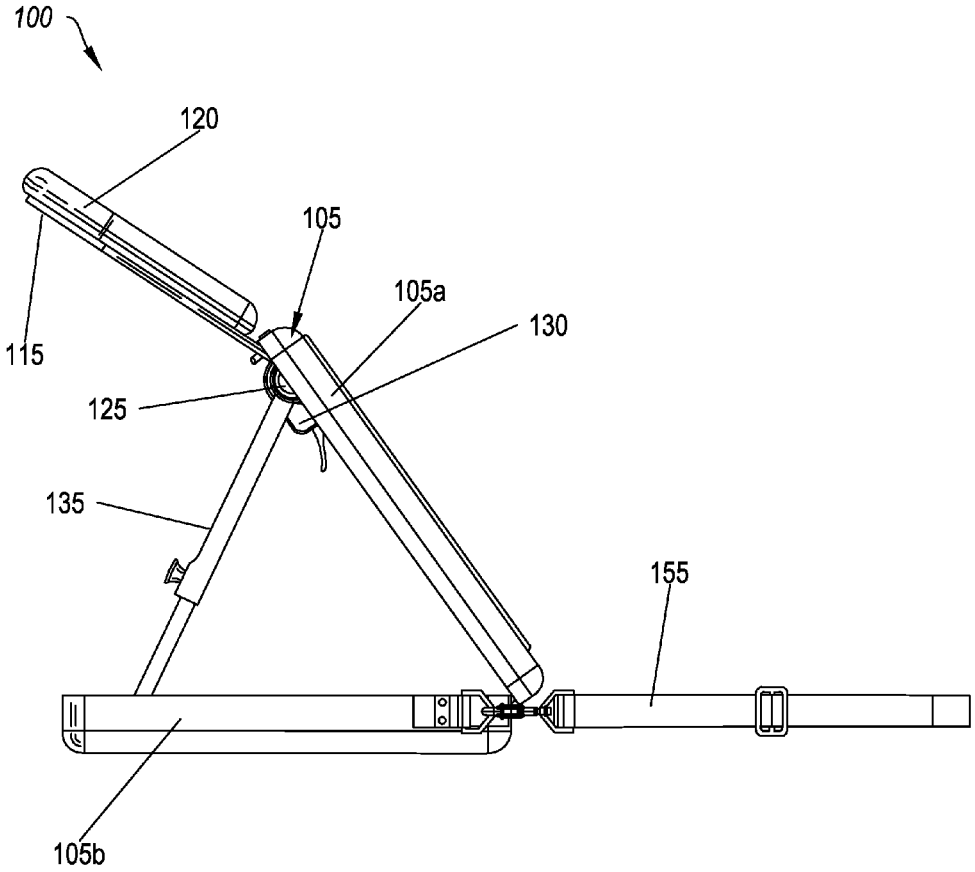
FIG. 1B is a side view of the portable sleeping device.

FIGS. 1A and 1B illustrate an example of portable sleeping device 100 in an open state. FIG. 1A is a perspective view of the portable sleeping device 100; and FIG. 1B is a side view of the portable sleeping device 100. In at least one implementation, the portable sleeping device 100 can facilitate improved sleeping comfort while in a seated position. For example, the portable sleeping device 100 can aid an individual in sleeping in a confined space where a sitting posture is prescribed or considered socially appropriate. Additionally or alternatively, the portable sleeping device 100 can be used to obtain a comfortable sleeping position on an airplane, a train, a bus, a car, a boat, or on some other form of transportation.

In at least one implementation, the portable sleeping device 100 can be constructed of, for example, metals and/or alloys, foam cushioning, and nylon. In some implementations, lighter materials (e.g., carbon fiber) and/or less material (thinner metals, perforated or hollow materials, etc.) can be used to increase the portability of the device.

FIGS. 1A and 1B show that the portable sleeping device 100 can include a case 105. In at least one implementation, the case 105 can contain the other elements of the portable sleeping device and can help ensure that the other elements of the portable sleeping device 100 can work with one another. Additionally or alternatively, the case 105 can be used to protect the elements of the portable sleeping device 100. In particular, the case 105 can protect elements that are susceptible to wear during use or storage. The case 105 can be made of any material which is configured to perform the functions of the case 105. For example, the case 105 can be made of wood, metal, plastic or any other suitable material.

FIGS. 1A and 1B also show that the case 105 can include a case top 105*a* and a case bottom 105*b*. In at least one implementation, one or both of the case top 105*a* and the case bottom 105*b* can include cushioning. The cushioning can protect the other elements of the portable sleeping device 100 when they come in contact with the either the case top 105*a*, the case bottom 105*b* or both. For example, the top 105*a* and the bottom 105*b* can include a layer of neoprene or neoprene like material.

FIGS. 1A and 1B further show that the case top 105*a* and the case bottom 105*b* can be connected by one or more hinges 110. In at least one implementation, the hinges 110 can include any device which connects the case top 105*a* to the case bottom 105*b* and allow movement of the case top 105*a* relative to the case bottom 105*b*. The one or more hinges 110 can allow the case top 105*a* and the case bottom 105*b* to rotate relative to one another.

FIGS. 1A and 1B additionally show that the portable sleeping device 100 can include a headrest (also "head rest") 115. In at least one implementation, the headrest 115 can support the head of the user. The headrest 115 can be made of any material capable of supporting the head of the user. For example, the headrest 115 can be made of metal, wood, plastic or any other material. The headrest 115 can have a 'U' or horseshoe shape. In at least one implementation, the headrest 115 can have a bend or ridge along some or all of its perimeter for added strength and/or reinforcement.

FIGS. 1A and 1B also show that the portable sleeping device 100 can include a face cushion 120 affixed to or laying on the headrest 115. In at least one implementation, the face cushion 120 can support the face of the user in a comfortable position during use, as described below. The face cushion 120 can be made of compressible foam and/or a covering (e.g., vinyl, leather, etc.) over compressible foam or any other suitable material.

FIGS. 1A and 1B further show that the portable sleeping device 100 can include a pivot shaft 125. In at least one implementation, the pivot shaft 125 can allow the headrest 115 to rotate relative to the case 105. In particular, the headrest 115 can be rotated about the pivot shaft 125 relative to the case 105 to allow the user to rest more comfortably. Additionally or alternatively, the headrest 115 can be rotated about the pivot shaft 125 relative to the case 105 to allow the headrest 115 to be stored within the case 105, as described below. One of skill in the art will appreciate that the pivot shaft 125 can be connected to the headrest 115 directly, can be inserted through holes in the base of the headrest 115 or can be connected in some other manner, unless otherwise specified in the claims.

FIGS. 1A and 1B additionally show that the portable sleeping device 100 can include a ratcheting mechanism 130. In at least one implementation, as the pivot shaft 125 rotates freely with respect to the case top 105*a*, but differential rotation is prevented between the headrest 115 and the pivot shaft 125. I.e., the ratcheting mechanism 130 can hold the headrest 115 at any of a number of stop positions defined by the number and spacing of teeth on the ratchet wheel within the ratcheting mechanism 130. The ratcheting mechanism 130 can allow a user of the portable sleeping device 100 to set the position of the headrest 115 to a position that he or she finds the most comfortable.

FIGS. 1A and 1B also show that the portable sleeping device 100 can include a support beam 135. In at least one implementation, the support beam 135 can support the headrest 115 while in use. Additionally or alternatively, the support beam 135 can support the portion of the case top 105*a* relative to the case bottom 105*b*, as described below. The support beam 135 can have an adjustable length and angle to increase user comfort, as described below.

FIGS. 1A and 1B further show that the portable sleeping device 100 can include one or more positioning stops 140. In at least one implementation, the one or more positioning stops 140 can be configured to receive a portion of the support beam 135. In particular, the one or more positioning stops 140 can prevent the support beam 135 from moving relative to the case bottom 105*b* while in use. Additionally or alternatively, the one or more positioning stops can allow the user to change the angle of the support beam 135 relative to the case bottom 105*b*.

FIGS. 1A and 1B also show that the portable sleeping device 100 can include a catch 145. In at least one implementation, the catch 145 to hold the support beam 135 when the portable sleeping device 100 is folded up into a closed state. For example, the catch 145 can be attached to the case top 105*a*. The catch 145 can include, for example, one or more metal tabs that flex or bow to enable the support beam to displace the tabs which then press against at least some portion of the support beam 135 to hold the support beam 135 in place.

FIGS. 1A and 1B further show that the portable sleeping device 100 can include one or more hand rests 150. In at least one implementation, the hand rests 150 provide a location for the user to rest his or her hands while sleeping. The hand rests 150 can be made of compressible foam and/or a covering over compressible foam (e.g., vinyl, leather, etc.). The hand rests 150 can be bifurcated to be in the unfolded position to facilitate closing of the portable sleeping device 100 and folded for user comfort, as described below.

FIGS. 1A and 1B also show that the portable sleeping device 100 can include a strap 155. In at least one implementation, the strap 155 can be used to carry the portable sleeping device 100. Additionally or alternatively, the strap 155 can be wrapped around a user's waist to hold the portable sleeping device 100 in place while the user sleeps.

In at least one implementation, a user can secure the portable sleeping device 100 to himself/herself by placing the strap 155 around user's waist and back. A clip at either end of the strap 155 permits a user to unclip the strap, wrap the strap around the user's waist/back and reclip the strap to the portable sleeping device 100. The user can open the case 105 of the portable sleeping device 100 and adjust the components to preferred positions. The user then simply leans their chest and head forward onto the chest and head pieces to reach a head/face forward position. The user's upper trunk and head weight are supported by the device so that passivity and rest are achieved. The spine is maintained in a generally neutral orientation. This places the user's neck and upper back in a low stress state. The generally horizontal head position allows for a potentially deeper REM sleep cycle. This can result in the user feeling more rested, without the sluggishness commonly associated with poor sleep quality.

Figure 2:
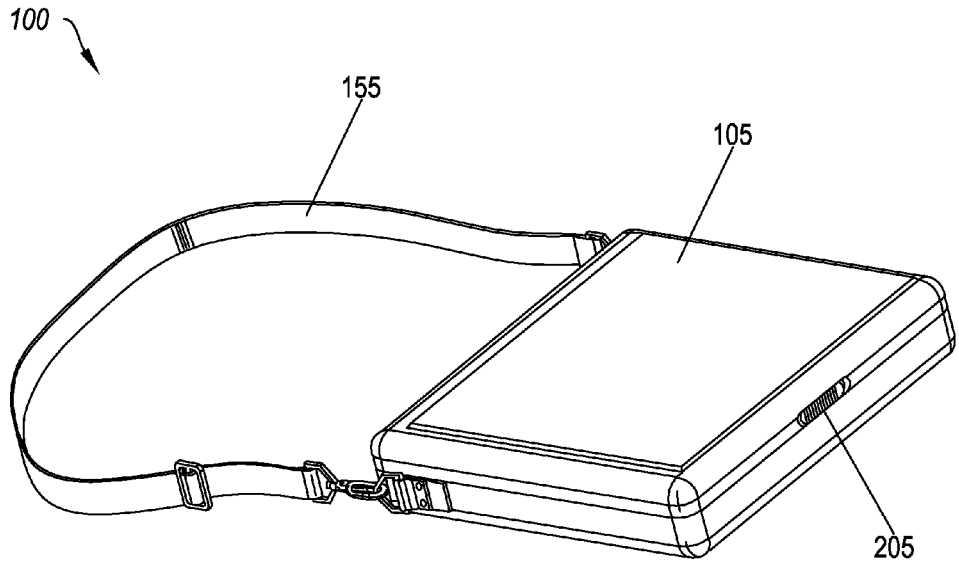
FIG. 2 illustrates a perspective view of the example portable sleeping device in a closed state.

FIG. 2 illustrates a perspective view of the example portable sleeping device 100 in a closed state. In at least one implementation, the portable sleeping device 100 in the closed state can store the other elements. This can allow a user to transport the portable sleeping device 100 or store the portable sleeping device 100 in a manner that will protect the other parts and/or require less room than the portable sleeping device 100 in the open position.

In at least one implementation, the example portable sleeping device 100 is designed to fold into a compact shape to enhance its portability. In some implementations this shape can resemble a small briefcase or laptop computer. This form factor permits storage of the portable sleeping device 100 in tight compartments, user luggage, or under a car, plane, or bus seat. Components of the example portable sleeping device 100 can be moved into position for use in the open state and this procedure can be reversed to position the components inside the portable sleeping device 100 case for portability.

FIG. 2 shows that the strap 155 can remain external to the case 105 if desired by the user. This can allow the user to carry the portable sleeping device 100 in the closed state. For example, the portable sleeping device 100 can be carried by a user with the strap 155 over the user's shoulder. Additionally or alternatively, the portable sleeping device 100 can include a handle on the exterior of the case 105.

FIG. 2 also shows that the portable sleeping device 100 can include a latch 205. In at least one implementation, the latch 205 can hold the case 105 in the closed position. For example, the latch 205 can releasably attach the case top 105*a* to the case bottom 105*b* to keep the case 105 shut. In particular, the latch 205 can include a pin, spring, and release.

Figure 3:
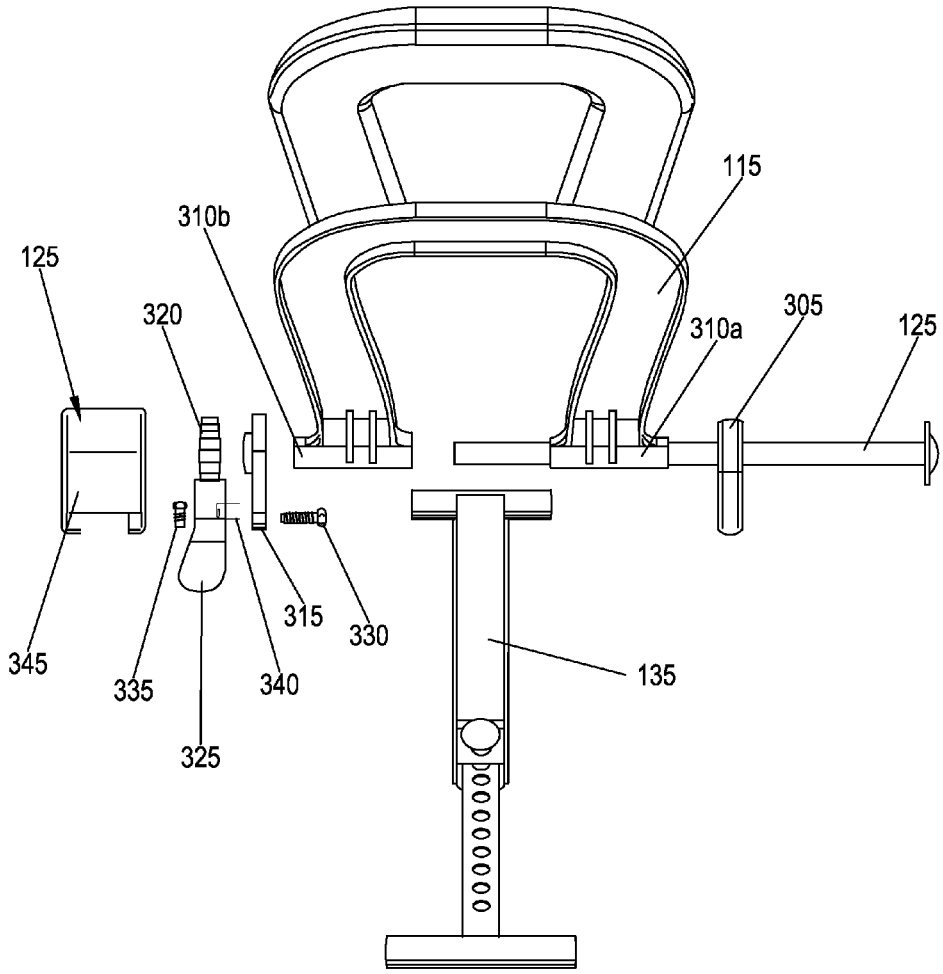
FIG. 3 illustrates an exploded view showing details of the pivot shaft, headrest, and ratchet mechanism.

FIG. 3 illustrates an exploded view showing details of the pivot shaft 125, headrest 115, and ratcheting mechanism 130. In at least one implementation, the pivot shaft 125 and the ratcheting mechanism 130 can allow the user to change the position of the headrest 115. I.e., the user can adjust the orientation of the headrest 115 relative to the case top. This can allow the user to place the headrest 115 in the position that is most comfortable for the user.

FIG. 3 shows that the pivot shaft 125 can pass through a pivot attachment 305. In at least one implementation, the pivot attachment 305 is attached to the case top. Attaching the pivot attachment 305 to the case top can ensure that the headrest 115 remains attached to the case top. One of skill in the art will appreciate that attaching the headrest 115 to the case top at a single point or points that are linear relative to one another will allow rotation of the headrest 115 relative to the case top.

FIG. 3 also shows that the headrest 115 can include a first base 310*a* and a second base 310*b* (collectively "bases 310"). In at least one implementation the bases 310 can include a hollow portion. For example, the bases 310 can include a hollow portion which is configured to receive the pivot shaft 125. Receiving the pivot shaft 125 in the bases 310 can allow the headrest 115 to rotate relative to the pivot shaft 125 and thus the case top. Additionally or alternatively, receiving the pivot shaft 125 in the bases 310 can allow the headrest 115 to rotate, in conjunction with the pivot shaft 125, relative to the pivot attachment 305 and thus the case top. I.e., the pivot shaft 125 and bases 310 can mate such that rotation of the headrest 115 relative to the pivot shaft 125 is prevented and thus both the pivot shaft 125 and the headrest 115 rotate in conjunction with one another relative to the case top. For example, the pivot shaft 125 and corresponding hollow portion of the bases 310 can be square, hexagonal or some other shape where they mate. Additionally or alternatively, the pivot shaft 125 can be welded to the bases 310.

FIG. 3 further shows that the pivot shaft 125 can be inserted into the ratcheting mechanism 130. In at least one implementation, the ratcheting mechanism 130 can allow the user to select the position of the headrest 115 relative to the case top. In particular, the ratcheting mechanism 130 can secure the position of the headrest 115 relative to the case top. One of skill in the art will appreciate that the functions of the ratcheting mechanism 130 can be performed by other mechanisms, such as stops, screws, catches, latches and the like.

FIG. 3 also shows that the ratcheting mechanism 130 can include a ratchet side 315. In at least one implementation, the ratchet side 315 can include an opening for the insertion of at least a portion of the pivot shaft 125. Additionally or alternatively, the ratchet side 315 can ensure that the ratcheting mechanism 130 can work properly. In particular, the ratchet side 315 can ensure that the other parts of the ratcheting mechanism 130 remain in appropriate contact with the pivot shaft 125, as described below.

FIG. 3 further shows that the ratcheting mechanism 130 can include a ratchet wheel 320. In at least one implementation, the pivot shaft 125 is connected to the ratchet wheel 320 such that rotation of the pivot shaft 125 induces rotation of the ratchet wheel 320 and vice versa. The ratchet wheel 320 can be secured in place to prevent rotation of the pivot shaft 125 and thus the headrest 115. Additionally or alternatively, the headrest 115 can be attached directly to the ratchet wheel 320 to prevent movement of the headrest 115.

FIG. 3 also shows that the ratcheting mechanism 130 can include a ratchet lever 325. In at least one implementation, the surface of the ratchet lever 325 making contact with one of a number of teeth of the ratchet wheel 320 keeps the pivot shaft 125 (and the headrest 115) from rotating in a direction that would permit the headrest 115 from rotating downward in the orientation shown in FIG. 3. Rotation in this direction does not occur unless the ratchet lever 325 is moved out of contact with the ratchet wheel 320 by, for example, being depressed by a user to cause the ratchet lever 325 to rotate out of contact with the ratchet wheel 320. I.e., depression of the ratchet lever 325 by the user's finger, releases the headrest 115 by disengaging the ratchet lever 325 from the ratchet wheel 320.

In at least one implementation, the ratchet wheel 320 includes eight teeth, each corresponding to a respective stop position of the headrest 115. Adjustment of the headrest 115 is made by lifting the headrest 115 until the desired position is reached, and one of the eight position stops is engaged by the ratchet lever 325. A user can then, for example, lean their head forward, resting their face on the face cushion and subjectively determine the comfort level. If further adjustment is desired, the headrest 115 can be raised if a steeper angle is desired, or lowered if less angle is desired.

FIG. 3 further shows that the ratcheting mechanism 130 can include a bolt 330. In at least one implementation, the ratchet lever 325 pivots about the center of the bolt 330. The bolt 330 is held in place through the ratchet side 315 and the ratchet lever 325 by a nut 335. In particular, the ratchet lever 325 can rotate about the bolt 330 and the nut 335 such that a portion of the ratchet lever 325 can placed in contact with the ratchet wheel 320.

FIG. 3 also shows that the ratcheting mechanism 130 can include a torsion spring 340. In at least one implementation, the torsion spring 340 can provide a biasing force on the ratchet lever 325. For example, the torsion spring 340 can bias the ratchet lever 325 to contact the ratchet wheel 320 absent an external force. The external force can include rotation of the ratchet wheel 320 or pressure on the ratchet lever 325 by the user, as described above.

To lower the headrest 115 the user can press the ratchet lever 325 to disengage it from the ratchet wheel 320. For example, a user can depress the ratchet lever to move the headrest 115 down to a preferred position or to rotate the headrest 115 into a position adjacent to and/or against the support beam 135 for closing of the portable sleeping device. Disengagement of the ratchet lever 325, which is held against the ratchet wheel 320 by the torsion spring 335, can be achieved, for example, by one or more fingers of a user's right hand. The headrest 115 can then be held, for example, by the user's left hand, while the ratchet lever 325 is held disengaged by the user's right hand.

FIG. 3 further shows that the ratcheting mechanism 130 can include a ratchet cover 345. In at least one implementation, the ratchet cover 345 can be used to protect the ratcheting mechanism 130. For example, the ratchet cover 345 can prevent dust or other debris from entering the ratcheting mechanism 130 and preventing rotation of the ratchet wheel 320 or the engagement of the ratchet lever 325. Additionally or alternatively, the ratchet cover 345 can be used to ensure that the elements of the ratcheting mechanism 130 remain aligned with one another to allow proper operation.

Figure 4:
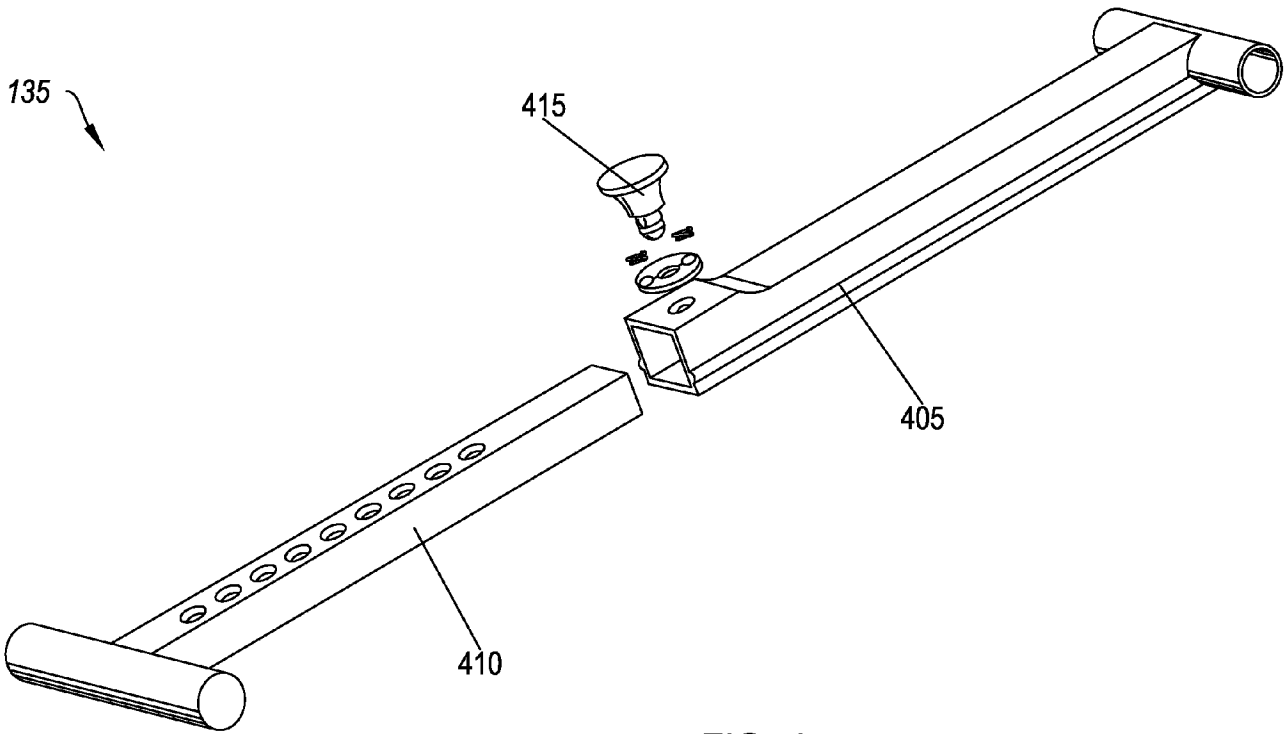
FIG. 4 illustrates an exploded view of the support beam of the example portable sleeping device.

FIG. 4 illustrates an exploded view of the support beam 135 of the example portable sleeping device 100. In at least one implementation, the support beam 135 can be used to support the case top relative to the case bottom. During use, the user can rest his/her trunk on the case top. Therefore, the support beam 135 can be used to support the trunk of the user when the user is sleeping in a sitting position.

FIG. 4 shows that the support beam can include a first section 405. In at least one implementation, the first section 405 can include a portion through which the pivot shaft 125 passes, as described above. I.e., the first section 405 can be attached to the case top and rotate relative to the case top. This can allow the user to change the angle of the support beam 135 relative to case top to change the angle of the case top relative to the case bottom.

FIG. 4 also shows that the support beam 135 can include a second section 410. In at least one implementation, the second section 410 is configured to move relative to the first section 405. For example, the first section 405 can include a hollow portion, into which the second section 410 is inserted. Additionally or alternatively, the first section 405 and the second section 410 can be attached in some other manner that lets the first section 405 and the second section 410 move relative to one another.

FIG. 4 further shows that the first section can include a connector 415. In at least one implementation, the connector 415 can releasably attach the first section 405 to the second section 410. For example, the connector 415 can include a spring loaded pin which passes through a hole the first section 405 into a hole in the second section 410. Either the first section 405 and/or the second section 410 can have multiple holes in order to allow the position of the first section 405 to be secured relative to the second section 410. One of skill in the art will appreciate that any connector 415 that releasably attaches the first section 405 to the second section 410.

In at least one implementation, the first section 405 can include a flared portion that provides clearance between the first section 405 and the second section 410. This can allow the connector, or portions thereof, to be located between the first section 405 and the second section, such as a spring loading disc and springs.

Figure 5A:
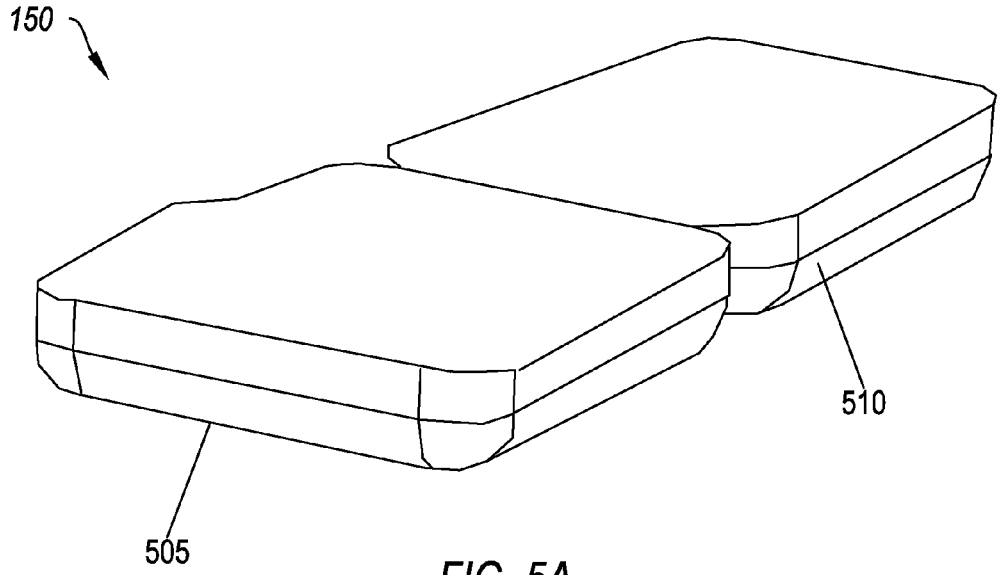
FIG. 5A illustrates a perspective view of a hand rest in an unfolded state.
Figure 5B:
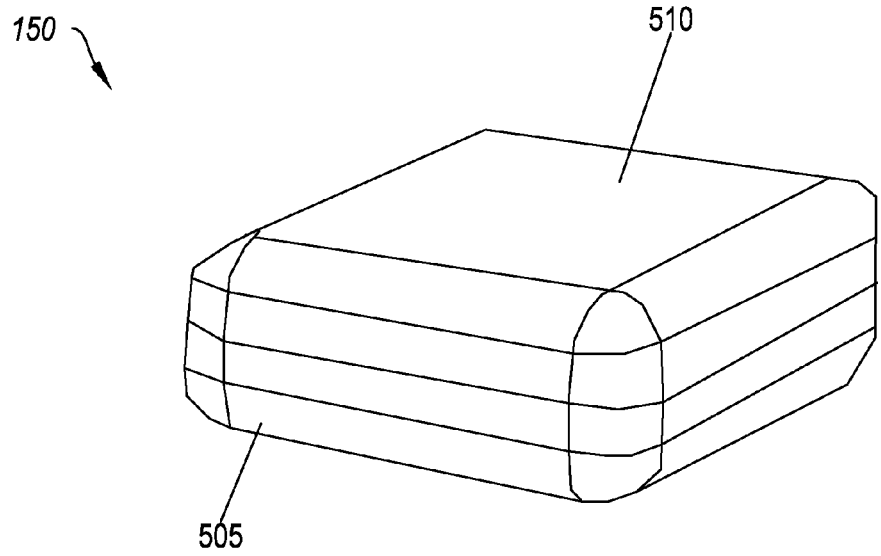
FIG. 5B illustrates a perspective view of a hand rest in a folded state.

FIGS. 5A and 5B illustrate an example of a hand rest 150. FIG. 5A illustrates a perspective view of a hand rest 150 in an unfolded state; and FIG. 5B illustrates a perspective view of a hand rest 150 in a folded state. In at least one implementation, the hand rest 150 is designed with ergonomic and/or anatomically derived shapes to provide comfortable support for a user's hands and/or forearms.

FIGS. 5A and 5B shows that hand rest 150 is bifurcated into a first section 505 and a second section 510 to facilitate closing of the portable sleeping device 100. The first section 505 and the second section 510 are joined at the bifurcation line. The bifurcation line can include, for example, a strip of the material that covers the hand rest 150 (e.g., vinyl, leather, etc.), a hinge, or some other material or structure that connects the first section 505 with the second section 510 and permits the hand rest 150 to be folded.

The example hand rest 150 can be, for example, folded when the case is open for use, the top of the hand rest 150 cushion being higher than the top edge of the portable sleeping device case bottom 105*b*, this allows for greater comfort to a user because the wrists can lie on the cushioning of the hand rest 150 and not on the rim of the portable sleeping device case bottom 105*b*. The example portable sleeping device 100 of FIG. 5, however, may not be able to be closed with the hand rests 150 in the folded state. The hand rests 150, can be unfolded into the slimmer profile depicted in FIG. 5A so that the portable sleeping device 100 can be closed. In use, a user can place his/her hands and/or forearms on the hand rests 150.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable sleeping device, the portable sleeping device comprising:

a case, wherein the case includes:

a first portion; and a second portion, wherein the second portion is attached to the first portion;

a headrest, wherein the headrest is configured to support the head of a user;

a pivot shaft, wherein the pivot shaft is configured to:

connect the headrest to the second portion of the case; and allow the headrest to rotate relative to the second portion of the case;

a ratcheting mechanism, wherein the ratcheting mechanism is configured to prevent rotation of the headrest in at least one direction relative to the second portion of the case;

a support shaft, wherein the support shaft is configured to support the position of the second portion of the case relative to the first portion of the case and wherein the support shaft includes;

a first section; and a second section, wherein the second section is configured to move relative to the first section in order to allow the user to change the length of the support shaft;

one or more position stops, wherein the position stops are configured to prevent movement of the support shaft relative to the first portion of the case; and one or more hand rests, wherein the one or more hand rests are configured to support the hands of the user; and wherein the case substantially encloses the other elements of the portable sleeping device when closed.

2. The portable sleeping device of claim 1 further comprising a strap, wherein the strap is configured to go around the user's waist.

3. The portable sleeping device of claim 1 further comprising a hinge wherein the hinge attaches the first portion of the case to the second portion of the case.

4. The portable sleeping device of claim 3 further comprising a latch, wherein the latch is opposite the hinge.

5. The portable sleeping device of claim 1 further comprising three position stops.

6. The portable sleeping device of claim 1, wherein the hand rests include a bifurcated pad.

7. The portable sleeping device of claim 1 further comprising a catch, wherein the catch is attached to the second section of the case and is configured to releasably connect to the support shaft.

8. The portable sleeping device of claim 1, wherein the ratcheting mechanism includes a release lever, wherein the release lever is configured to disengage the ratcheting mechanism and allow free rotation of the headrest.

9. The portable sleeping device of claim 1, wherein the headrest includes a face pad.

* * * * *